US006346212B1

(12) United States Patent
Seo et al.

(10) Patent No.: US 6,346,212 B1
(45) Date of Patent: Feb. 12, 2002

(54) CONVERTER

(75) Inventors: Sung-Mo Seo; Chang-Hee Yim; Joung-Mo Lee; Kyoung-Mok Lee, all of Pohang (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/558,111

(22) Filed: Apr. 25, 2000

(51) Int. Cl.[7] ..... C21B 7/12
(52) U.S. Cl. ..... 266/45; 266/220; 266/230
(58) Field of Search ..... 266/45, 217, 220, 266/227, 230, 236

(56) References Cited

U.S. PATENT DOCUMENTS 2,828,516 A * 4/1958 Black et al. ..... 266/227
4,931,090 A * 6/1990 Bottinelli et al. ..... 266/217

OTHER PUBLICATIONS

"Current Advances in Materials and Processes", *Report of the ISIJ Meeting, The Iron and Steel Institute of Japan*, Dec. 2000, vol. 13, No. 1, 5 pages.

* cited by examiner

*Primary Examiner*—Scott Kastler
(74) *Attorney, Agent, or Firm*—Baker Botts LLP

(57) ABSTRACT

A converter includes a side wall, and a tapping hole placed at the side wall to allow passage of molten steel. A refractory plug is axially spaced apart from the tapping hole with a predetermined distance. The distance between the refractory plug and the tapping hole is in the range of 3–5 d where d indicates the inner diameter of the tapping hole. The refractory plug has one or more heat resisting steel tubes. When the molten steel is discharged through the tapping hole of the converter to the ladle, 0.1–0.4 $Nm^3$/min of inert gas is introduced into the converter through the refractory plug to prevent leakage of the carried over slag.

10 Claims, 4 Drawing Sheets

CONVERTER

BACKGROUND OF THE INVENTION (a) Field of the Invention

The present invention relates to a converter and, more particularly, to a converter which can discharge molten metal to a suitable place free from slag.

(b) Description of the Related Art

Generally, molten pig iron passed through hot metal pretreatment process such as de-phosphorization and de-sulphurization is charged into a converter together with other materials including main components such as scrap and cold iron, and subsidiary components such as quick lime, dolomite and iron ore. The charge is then refined through oxygen blowing so that it is converted to steel. Such a refining treatment is performed for about 17 minutes.

FIG. 1A illustrates the process of discharging the molten steel from the converter after the refining treatment. As shown in FIG. 1A, the converter 1 is tilted by a predetermined angle, and the molten steel 3 is poured off into a ladle 2 through a tapping hole 5 within about five minutes. As the pouring of the molten steel 3 should be performed free from slag, such a process is usually called the "slag free tapping."

However, as shown in FIG. 1B, in the slag free tapping process, large sized vortex is formed at the molten steel 3 and the slag 4, and much of the slag 4 is carried over from the converter and flowed into the ladle 2 in addition to the molten steel 3. This makes bad effect to the cleanliness of the steel, and makes it difficult to control slag composition at the second refining process. Furthermore, large amount of deoxidizing agent should be additionally used to deoxidize the slag accompanied with the molten steel.

FIG. 2A illustrates a technique of blocking leakage of the carried over slag 4 from the converter 1 based on a large sized spherical slag check ball 7. As shown in FIG. 2B, the slag check ball 7 has a specific gravity higher than the slag 4, but lower than the molten steel 3. Therefore, when the molten steel 3 and the slag 4 are coexistent, the slag check ball 7 is constantly disposed between the molten steel 3 and the slag 4. That is, as shown in FIG. 20, the slag check ball 7 separates the slag 4 from the molten steel 3 during the slag free tapping process. However, the slag check ball 7 blocks the tapping hole 5 only when most of the molten steel is poured off. Practically, the slag check ball 7 is floating over the molten steel or rotated due to the influence of the vortex 6 during most of time for the slag free tapping process. Therefore, this technique cannot effectively block leakage of the carried over slag 4 due to the vortex 6.

Korean Patent Application Nos. 1991-24901 and 1992-9531 disclose another technique of blocking leakage of the carried over slag from the converter. In this technique, a gas blower is provided at the slag check ball charging equipment to blow gas onto the slag layer. When the gas is blown into the converter, naked molten steel becomes generated at the top side of the tapping hole, and the slag is thrust toward the periphery. However, in this technique, the slag check ball charging equipment with the gas blower should move forwards correctly at the tilting time of the converter, and after the tilting, the slag check ball charging equipment should again move backwards in a suitable manner. Furthermore, in such a structure, high pressure gas is liable to be blown into the converter so that the molten steel becomes turbulent, rather causing leakage of the slag. In addition, either a separate gas blower should be provided at the converter, or the existent slag check ball charging equipment should be re-made such that it has both of the capacities of charging the slag check ball and blowing gas into the converter. In short, the above technique involves complicated processing steps, making it difficult to be employed in practical application.

Alternatively, it has been suggested that a porous typed tapping hole may be used to blow gas into the converter. In this technique, the tapping hole is formed with a porous refractory material. A gas line is connected to the porous typed tapping hole, and gas is blown into the converter through the pores of the tapping hole. Therefore, the gas blown into the converter generates naked molten steel at the top side of the tapping hole, and forces the slag toward the periphery to thereby block leakage of the carried over slag. However, as the life cycle of the porous typed tapping hole is at best 2–5% compared to the main body of the converter, it should be frequently replaced by a new one. Furthermore, the porous typed tapping hole is liable to be eroded due to the blown gas. In addition, when the gas is blown into the converter through the porous typed tapping hole, the in-flowing speed of the gas is seriously less than the out-flowing speed of the molten steel so that the gas is rather forced toward the tapping hole, causing erosion of the tapping hole and delay in tapping time. In this situation, when the amount of gas increases to overcome such a problem, the tapping time becomes longer as much.

As described above, the conventional techniques of blocking leakage of the carried over slag at the slag free tapping process bear complicated processing steps, poor production efficiency, and other structural problems.

SUMMARY OF THE INVENTION

It is an object of the present invention to provide a converter which can effectively block leakage of the carried over slag during the slag free tapping process in a stable manner.

This and other objects may be achieved by a converter. The converter includes a side wall, and a tapping hole placed at the side wall to allow passage of molten steel. A refractory plug is axially spaced apart from the tapping hole with a predetermined distance. The distance between the refractory plug and the tapping hole is in the range of 3–5d where d indicates the inner diameter of the tapping hole. The refractory plug has one or more heat resisting steel tubes.

When the molten steel is discharged through the tapping hole of converter to the ladle, inert gas, for example nitrogen or argon gas, is introduced into the converter through the refractory plug with a small amount of flow rate to prevent leakage of carried over slag.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1A:
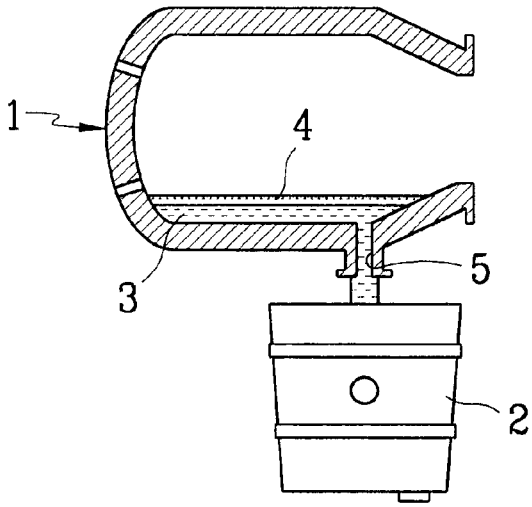
FIG. 1A is a schematic view of a converter according to a prior art.
Figure 1B:
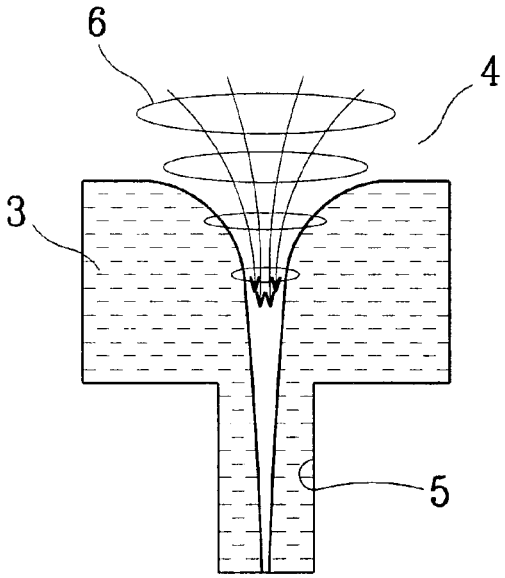
FIG. 1B is a simulation view of a vortex occurring in the converter shown in FIG. 1A.
Figure 2A:
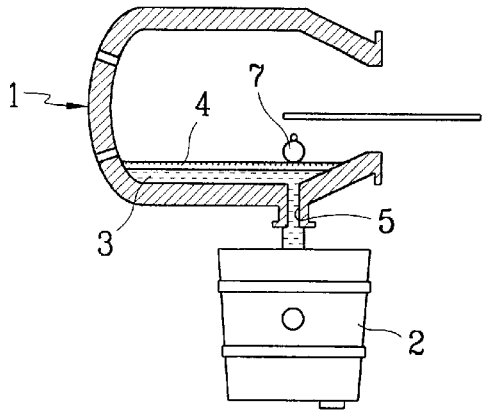
FIG. 2A is a schematic view of a converter with a slag check ball according to another prior art.
Figure 2B:
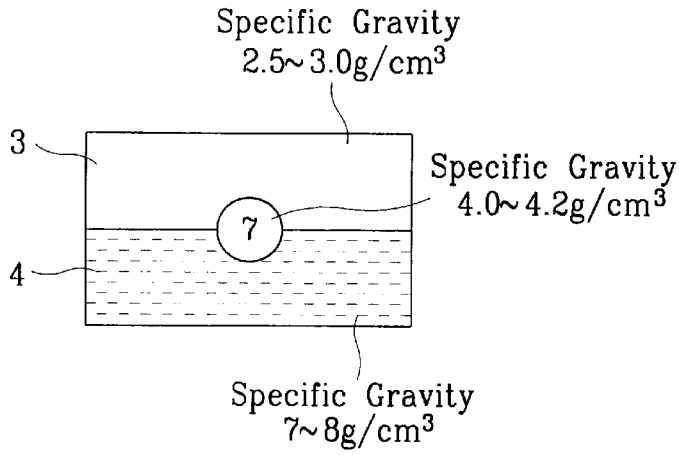
FIG. 2B is an amplified view of the slag check ball shown in FIG. 2A.
Figure 2C:
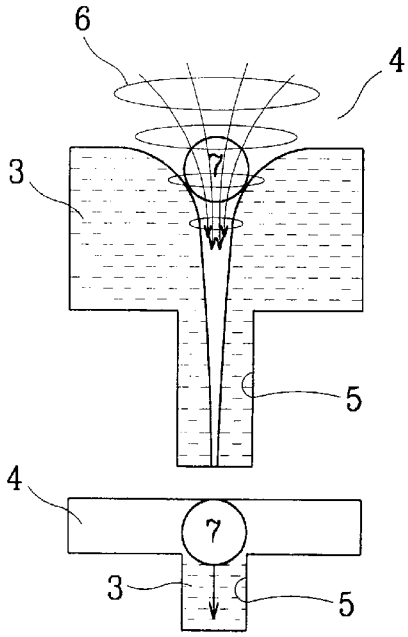
FIG. 2C is a simulation view of a vortex occurring in the converter with the slag check ball shown in FIG. 2A.
Figure 3:
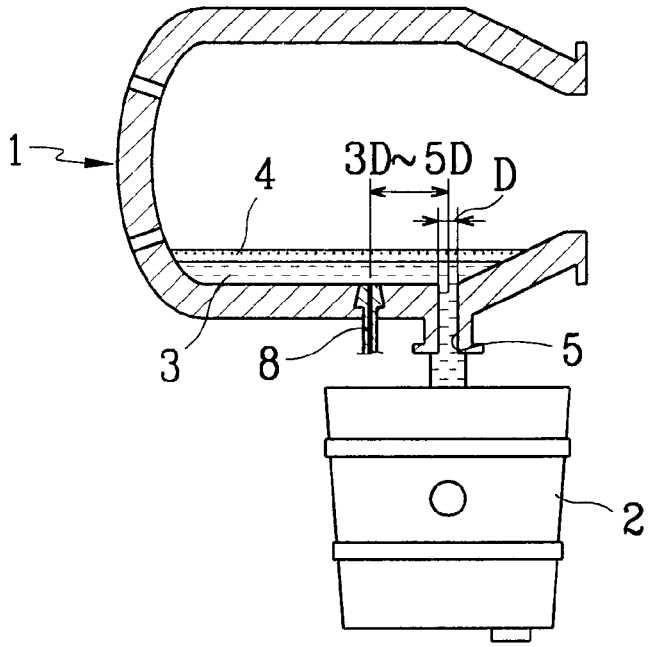
FIG. 3 is a schematic view of a converter with a gas inlet plug and a tapping hole according to a preferred embodiment of the present invention.

FIG. 3 shows a schematic view of a converter with a gas inlet plug according to a preferred embodiment of the present invention.

As shown in FIG. 3, the converter 1 has a tapping hole 5 through which a molten steel 3 is poured off into a ladle 2, and a gas inlet plug 8 positioned close to the tapping hole 5. The tapping hole 5 and the gas inlet plug 8 are placed at the side wall of the converter 1 side by side.

The gas inlet plug 8 is formed with a refractory material such as MgO, and internally provided with one or more stainless tubes. The stainless tube of the gas inlet plug 8 has an inner diameter of 4 mm or less.

Considering that the refractory material for the gas inlet plug 8 has a plurality of micro-pores, the stainless tube is provided at the gas inlet plug 8 to prevent reduction in life cycle thereof.

Any material exhibiting the same degree of anti-erosion or fire-resistance as stainless steel or more may be applied for such a tube.

The inner diameter of the stainless tube for the gas inlet plug 8 is established to be 4 mm or less. When it exceeds 4 mm, the molten steel 3 may intrude into the tube. It is more preferable for the tube fabrication efficiency that the inner diameter of the tube is in the range of 2–4 mm.

The number of the stainless tubes may be varied depending upon the operating efficiency of the converter 1.

The axial distance between the tapping hole 5 and the gas inlet plug 8 is established to be set in the range of 3–5 d where d indicates the inner diameter of the tapping hole 5. When the gas inlet plug 8 is too close to the tapping hole 5, the gas passed through the gas inlet plug 8 does not rise to the direction of the surface of steel and slag layer but intrudes into the tapping hole 5, increasing the erosion degree of the tapping hole 5 and the tapping time. In this respect, the minimum distance between the tapping hole 5 and the gas inlet plug 8 is established to be 3 d. In contrast, when the gas inlet plug 8 is too distant from the tapping hole 5, the gas introduced through the gas inlet plug 8 does not effect the desired blocking of the vortex. Therefore, the maximum distance between the tapping hole 5 and the gas inlet plug 8 is established to be 5 d.

The flux of inert gas, for example nitrogen or argon gas, flowed into the converter 1 through the gas inlet plug 8 is established to be 0.1–0.4 $Nm^3$/min. When the flux of gas is less than 0.1 $Nm^3$/min, vortex is liable to be generated at the final point of the pouring of the molten steel. In contrast, when the flux of gas exceeds 0.4 $Nm^3$/min, it is liable to occur that the molten steel and the slag are mixed together or splashed due to excess gas flow rate or the plug is over-eroded, causing reduction in life cycle thereof.

Figure 4:
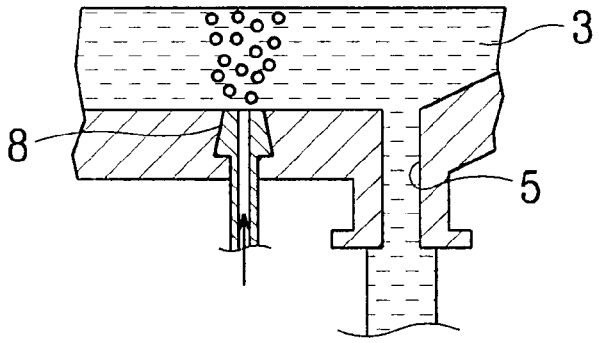
FIG. 4 is a schematic view illustrating an operational state of the converter with the gas inlet plug shown in FIG. 3.

FIG. 4 illustrates an operational state of the converter 1 with the aforementioned gas inlet plug 8 where vortex is absent.

As shown in FIG. 4, the gas introduced into the converter 1 bubbles upward to thereby generate irregular turbulence, and the turbulence blocks generation of the vortex at the later time. This is merely not to delay the formation time of the vortex like the conventional vortex prevention dam at the ladle or tundish, but blocks generation of the vortex at its root.

EXAMPLE 1

A slag free tapping simulation was performed with a 300 ton of acryl-based converter reduced in size by about 1/13. Water was replaced for the molten steel, and oil (specific gravity of 0.5–0.6 g/$cm^3$) for the slag. A manual tilting machine was installed at the converter such that the converter can be manually tilted.

Other relevant conditions of the simulation were established to be approximated to the practical working conditions.

The amount of water was 22 l, and the amount of slag was up to 1 l to estimate the formation of vortex and the leakage of slag in a suitable manner.

The amount of gas was established to be 2 l/min at the bottom such that the similarity with respect to the 300 ton of converter should agree to the modified Froude number. This amounts to about 0.25 $Nm^3$/min in practical application. The gas introducing positions based on a gas inlet plug were established to be 28 mm, 48 mm, 68 mm, 88 mm, 108 mm distant from the center of the tapping hole of the converter. The inner diameter of the tapping hole was established to be 16 mm.

The simulation was repeatedly performed in the above conditions, and the amount of oil leakage was checked at each simulation. The results were indicated in FIG. 5.

Figure 5:
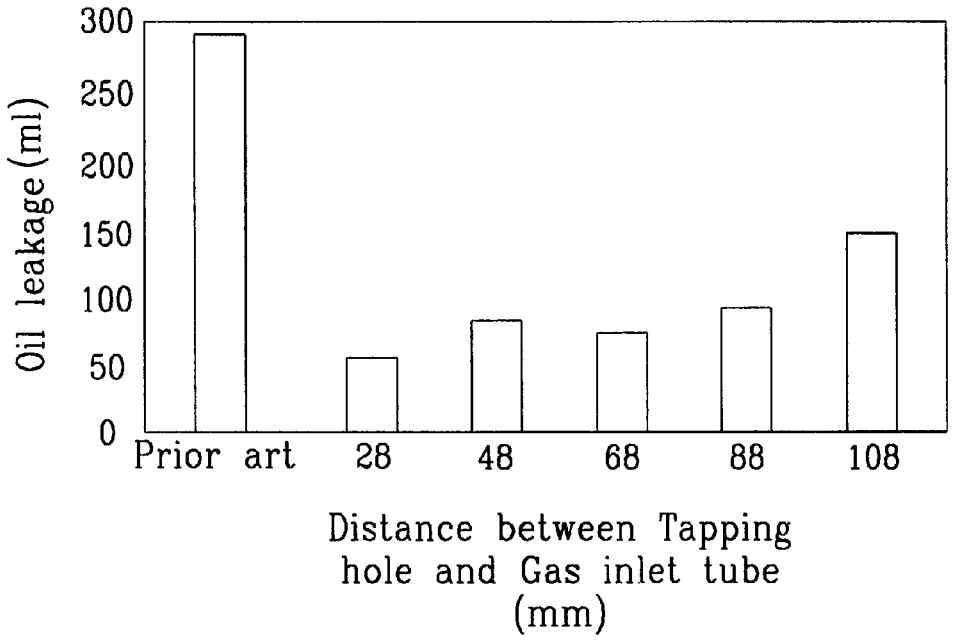
FIG. 5 is a graph illustrating the amount of leakage of oil as a function of the distance between the gas inlet plug and the tapping hole shown in FIG. 3.

As estimated from FIG. 5, the amount of oil leakage according to the conventional technique was about 290 ml, whereas the amount of oil leakage based on the inventive gas inlet plug was 60–145 ml. That is, the inventive gas inlet plug could give 50–80% of reduction in the amount of oil leakage. Furthermore, the larger the distance between the gas inlet plug and the tapping hole was, the amount of oil leakage became greater as much. The amount of oil leakage was smallest at the 28 mm position where the distance between the gas inlet plug and the tapping hole is smallest. But, in such a position, gas intrudes into the tapping hole so that it causes erosion of the tapping hole and delay in the tapping time. Therefore, the optimum position of the gas inlet plug is 48–88 mm distant from the tapping hole that is in the range of 3–5 d where d indicates the inner diameter of the tapping hole.

As described above, the inventive gas inlet plug can prevent occurrence of the vortex during the slag free tapping process so that leakage of carried over slag due to the vortex can be blocked. In this connection, the amount of usage of the subsidiary materials such as de-oxidizing agent and quick lime can be reduced, and the re-phosphorization occurring in the deoxidization of the slag can be reduced. Consequently, high-cleanliness of the molten steel can be ensured while reducing in working load.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method of discharging molten steel from a converter free from slag, the converter comprising a tapping hole for pouring off the molten steel to the outside, and a refractory plug axially spaced apart from the tapping hole with a predetermined distance, the predetermined distance being in the range of 3–5 d where d indicates the inner diameter of the tapping hole, the refractory plug having one or more heat resisting steel tubes, the method comprising the step of:

discharging the molten steel through the tapping hole to the outside while blowing inert gas into the converter through the refractory plug.

2. The method of claim 1 wherein the heat resisting steel tube has a diameter of 4 mm or less.

3. The method of claim 2 wherein the heat resisting steel tube is formed with a stainless steel.

4. The method of claim 1 wherein the inert gas is nitrogen or argon gas.

5. The method of claim 4 wherein the flux of the inert gas is 0.1–0.4 $Nm^3$/min.

6. The method of claim 5 wherein the refractory plug is formed with MgO.

7. A converter comprising:

a side wall;

a tapping hole placed at the side wall to allow passage of molten steel; and a refractory plug axially spaced apart from the tapping hole with a predetermined distance, the predetermined distance being in the range of 3–5 d where d indicates the inner diameter of the tapping hole, the refractory plug having one or more heat resisting steel tubes.

8. The converter of claim 7 wherein the heat resisting tube has a diameter of 4 mm or less.

9. The converter of claim 8 wherein the heat resisting tube is formed with a stainless steel.

10. The converter of claim 7 wherein the refractory plug is formed with MgO.

* * * * *